US005462194A

United States Patent [19]

Barnwell

[11] Patent Number: 5,462,194

[45] Date of Patent: Oct. 31, 1995

[54] SELF-VENTING STRAW TIP

[75] Inventor: Keith D. Barnwell, Brampton, Canada

[73] Assignee: Candea Inc., Brampton, Canada

[21] Appl. No.: 371,100

[22] Filed: Jan. 11, 1995

[51] Int. Cl.[6] ..... A47G 19/22; A47G 21/18; B65D 47/12

[52] U.S. Cl. ..... 220/709; 220/705; 239/33

[58] Field of Search ..... 220/705, 714, 220/708, 709; 222/525; 239/33

[56] References Cited

U.S. PATENT DOCUMENTS

| | | | |
|---|---|---|---|
| D. 95,675 | 5/1935 | Fuerst . | |
| D. 96,766 | 9/1935 | Kronman . | |
| D. 99,274 | 4/1936 | Fleisch . | |
| D. 99,327 | 4/1936 | Howie, Jr. . | |
| D. 105,858 | 8/1937 | Fleisch . | |
| D. 113,394 | 2/1939 | Piluso . | |
| D. 114,053 | 4/1939 | Barnes . | |
| D. 266,906 | 11/1982 | Guerette . | |
| D. 321,457 | 11/1991 | Kahl . | |
| D. 327,016 | 6/1992 | Leuenberger . | |
| D. 327,848 | 7/1992 | Hanover . | |
| D. 329,174 | 9/1992 | Patterson . | |
| D. 334,341 | 3/1993 | Brown et al. . | |
| D. 337,921 | 8/1993 | Iodice . | |
| 2,192,037 | 2/1940 | Hamilton | 239/33 |
| 2,248,231 | 7/1941 | Hamilton | 239/33 |
| 2,586,775 | 2/1952 | Benner et al. . | |
| 2,775,369 | 12/1956 | Waite . | |
| 2,783,919 | 3/1957 | Ansell . | |
| 3,173,566 | 3/1965 | Talbert . | |
| 4,408,700 | 10/1983 | Fillmore et al. . | |
| 4,448,316 | 5/1984 | Hiroshige . | |
| 4,909,408 | 3/1990 | Kos . | |
| 4,966,300 | 10/1990 | Coonradt . | |
| 5,048,705 | 9/1991 | Lind et al. . | |

FOREIGN PATENT DOCUMENTS

| | | |
|---|---|---|
| 46244 | 11/1979 | Canada . |
| 52167 | 11/1983 | Canada . |
| 56543 | 7/1986 | Canada . |
| 66458 | 7/1990 | Canada . |
| 9203372 | 3/1992 | WIPO . |

OTHER PUBLICATIONS

Applicant discloses a closure cap sold by an entity called Nepco in the United States. Applicant encloses a sample of the Nepco product.

*Primary Examiner*—Allan N. Shoap
*Assistant Examiner*—Robin A. Hylton
*Attorney, Agent, or Firm*—Brian W. Gray

[57] ABSTRACT

A straw for a drinking container that is self-ventilating and self-sealing. The straw has two parts, a straw tip and a straw cover. The cover is retained on the straw tip and is movable by manual pressure between a closed position and an open position. The tip has a solid closed top and an open bottom to allow for a straw extension piece to extend into the container for drawing liquid up into the straw. The straw is self-sealing in that a hole in the cover through which a user would suck is sized to sealingly fit the end of the tip in the closed position. In addition, the cover and tip are sealed at the open bottom in the closed position and drainage holes in the tip allow any liquid that falls between the cover and the tip to flow back into the container. The tip has an abutment surface around its perimeter between holes that release liquid in the user's mouth and holes that allow for air intake. The straw is self ventilating in that when the cover, which is attached to the tip just above the abutment surface, is moved to the open position, ridges on the inner surface of the cover grasp the tip's surface at certain points so as to automatically allow air into the container to draw out liquid, while at the same time preventing air from entering the user's mouth.

8 Claims, 4 Drawing Sheets

SELF-VENTING STRAW TIP

This invention relates to straws for containers that hold liquids for driving. In particular, this invention relates to a self-ventilating and self-sealing straw tip and straw tip cover for a drinking container which is attached to a closure cap for the container. The straw tip is self-ventilating in its open position and self-sealing in its closed position and also has means for draining fluid back into the container.

BACKGROUND OF THE INVENTION

A number of straws are known that provide venting means and sealing means.

U.S. Pat. No. 4,448,316 shows a bottle containing a spring loaded straw. When the bottle cap is open the straw pops out and the venting action is provided directly around the body of the straw.

U.S. Pat. No. 4,966,300 shows a drinking container having two straw portions. The lower straw portion is fixed in position and the upper straw portion is movable between a down storage position and an up in-use position. When the upper straw is pulled upwardly, it opens the liquid path from the container. When the upper straw is pushed back down, it closes the liquid path. A separate vent is provided through the cap and this vent is open and closed by the closure cap not by movement of the upper straw.

U.S. Pat. No. 5,048,705 shows a cap with a centre straw and a separate side vent open independently of the straw.

U.S. Pat. No. 3,173,566 shows a container with a vertically movable straw and a vent which is opened and closed by means of a rotating cap on the container.

U.S. Pat. No. 4,909,408 describes a specific venting structure but does not describe a straw or spout movable in combination with a vent.

SUMMARY OF THE INVENTION

The present invention provides, in a first aspect, a straw for a drinking container, having a tip with (a) an internal channel terminating at a solid closed top and an open bottom, (b) at least one first hole for liquid egress through the side of the tip into the channel and (c) at least one second hole through the side of the tip into the channel for air intake lower than the first hole. The tip has an abutment surface around the outside of the perimeter of the tip between the first hole and the second hole. The straw has a hollow cover movably retained on the tip and surrounding the tip, the cover having a hole at its upper end sized to fit around the solid top of the tip in sealing engagement when in a first closed position and in disengagement when in a second opened position so as to allow liquid to be removed in such second position. A first ridge on an inner surface of the cover is sized to sealingly engage the abutment surface of the tip when in the second open position. A second ridge on an inner surface of the cover below the first ridge sealingly engages the tip below the second hole when in the first closed position and disengages from the tip when in the second open position so as to allow air into the second hole in such second position.

The straw may include a straw extension which is sealingly attached to the open bottom of the tip and extends downwardly to reach a liquid in the container.

The straw may be part of a closure cap for a drinking container.

The tip may have a third hole through the side of the tip into the channel located between the first hole and the abutment surface.

Any of the first, second or third holes may be a plurality of holes spaced around the perimeter of the tip.

The tip and cover may be cylindrical.

The abutment surface may extend around the entire outside perimeter of the tip and the first ridge may extend around the entire inside perimeter of the cover.

The second ridges may extend around the entire inside perimeter of the cover.

BRIEF DESCRIPTION OF THE DRAWINGS

For a better understanding of the present invention and to show more clearly how it may be carried into effect, reference will now be made by way of example to the accompanying drawings, which show an apparatus according to the preferred embodiment of the present invention and in which.

DETAILED DESCRIPTION OF THE PREFERRED EMBODIMENT

Figure 1:
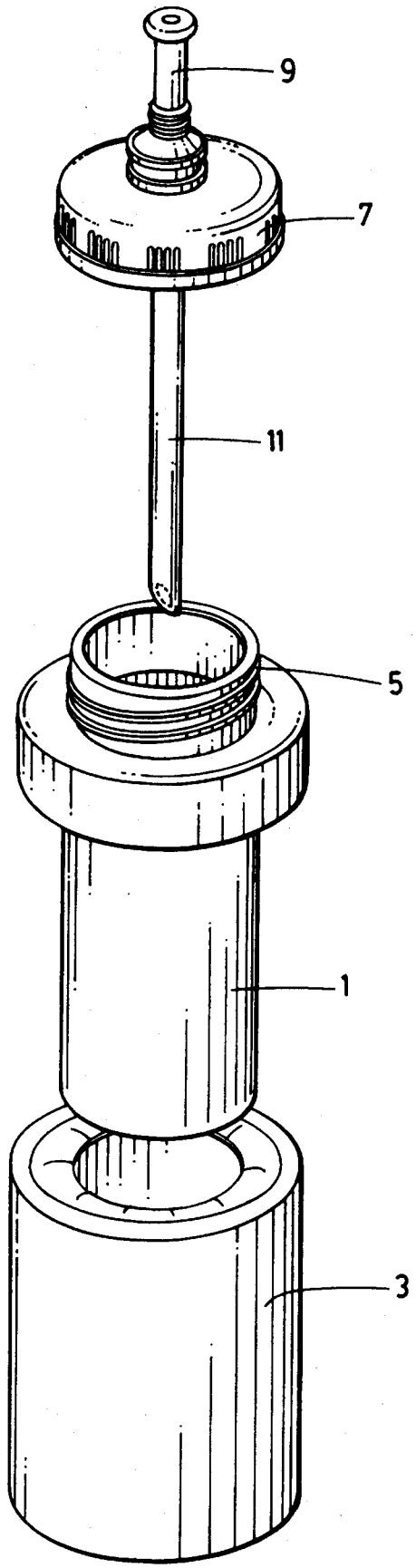
FIG. 1 is an exploded perspective view of a straw according to the preferred embodiment of the present invention shown with a closure cap, a straw extension and a drinking container.

Referring to FIG. 1, there is shown a drinking container 1 which is normally designed to hold a cold or hot liquid and is therefore surrounded by a thermally insulated outer layer 3. Container 1 has threads 5 on which is screwed a closure cap 7. Attached to the closure cap is a straw 9 having two parts (not shown in FIG. 1 ), a straw tip and a straw cover, to be described further later.

The straw has connected to it a straw extension piece 11 which extends from the straw on underside of the closure cap 7 into the container 1 for drawing liquid up into straw 9.

Figure 2:
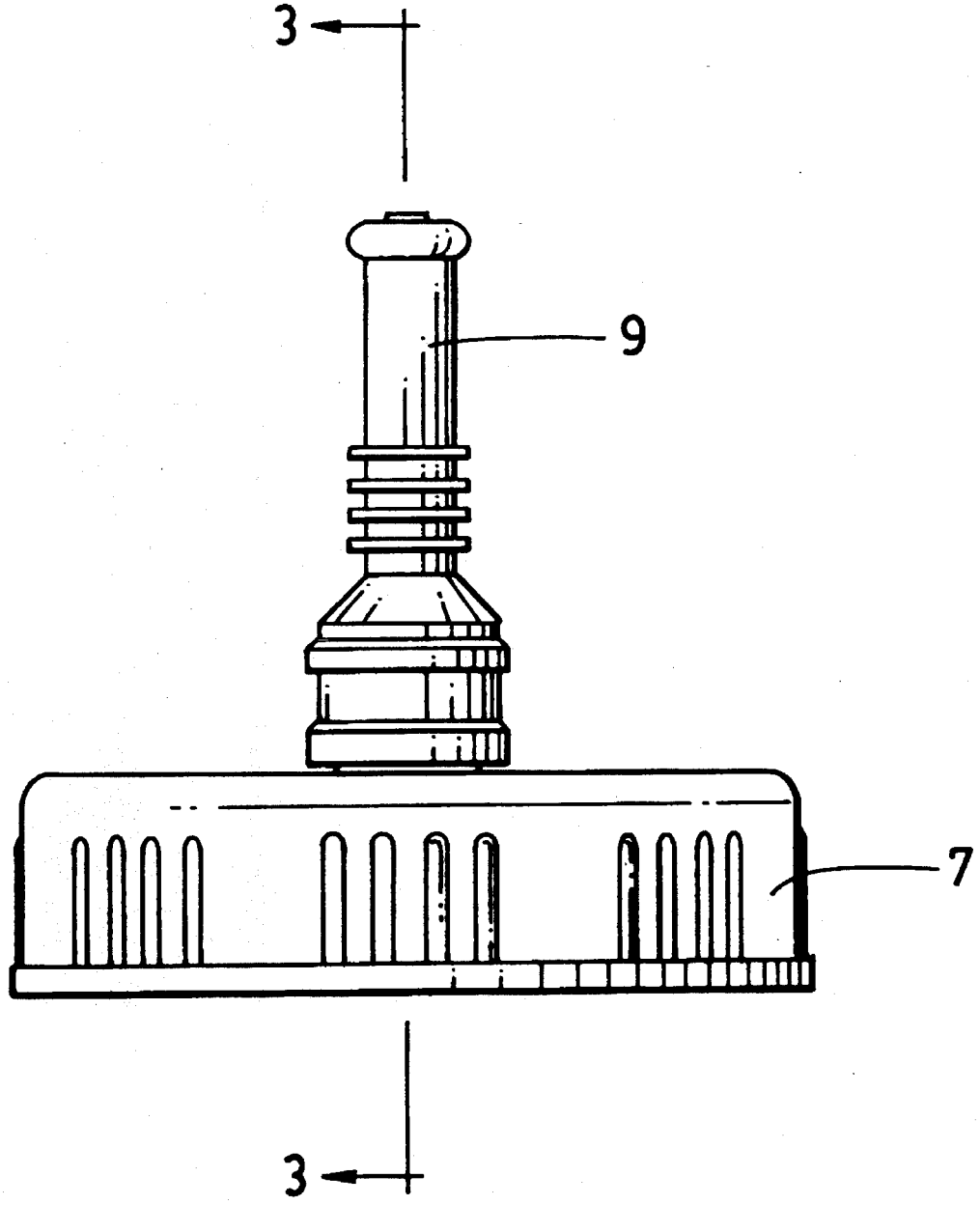
FIG. 2 is a side elevation of the straw and the closure cap of FIG. 1.

The closure cap and straw are shown in more detail in FIG. 2.

Figure 3:
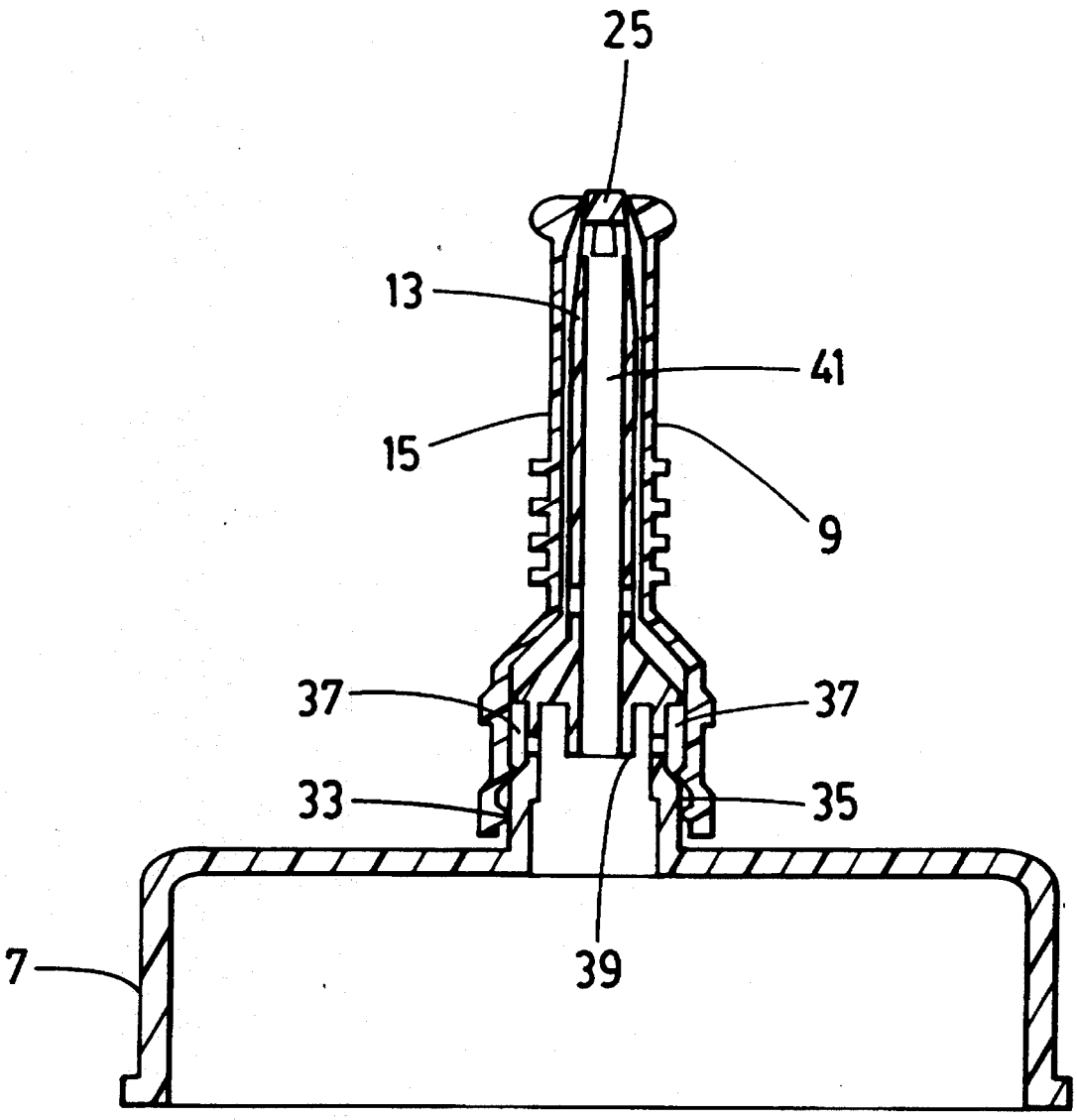
FIG. 3 is a cross-section of the straw and the closure cap of FIG. 2 shown in a closed position and taken along lines 3—3.

In FIG. 3, a cross-section taken along the lines 3—3 in FIG. 2, the closure cap 7 and the straw tip 13 are moulded from a single piece so that the straw tip 13 extends upwardly from the closure cap 7. While shown as a single moulded piece, it is possible for the straw tip 13 to be screwed onto the closure cap or in any other way attached to the closure cap in a sealing engagement. Straw tip 13 has cover 15 retained on it.

Figure 4:
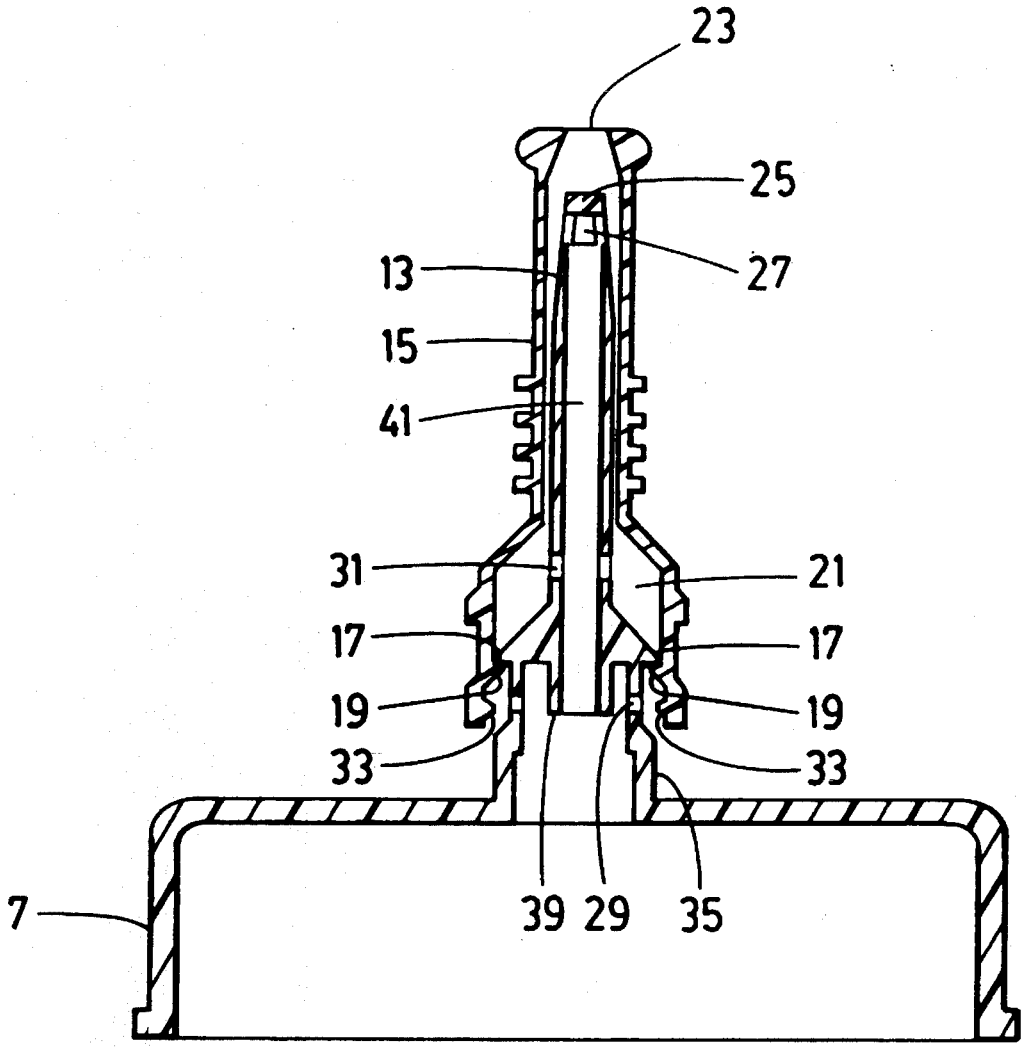
FIG. 4 is a cross-section of the straw and the closure cap of FIG. 2 shown in open position and taken along lines 3—3.

Cover 15 is movable by manual pressure between a closed position shown in FIG. 3 and an open position shown in FIG. 4.

Cover 15 contains a hole 23 through which a user would suck to create a vacuum. The end 25 of tip 13 is solid and is sized to fit snugly and in sealing engagement into hole 23 when the cover 15 is in the closed position as shown in FIG. 3. Tip 13 also contains holes 27 (only one of which is visible) along the side of the tip through which liquid can be pulled by the action of the vacuum created by the user at hole 23.

The maximum extension of upward travel of cover 15 is limited by abutment surface 17 which extends around the periphery of tip 13 and which contacts ridge 19 which also extends around the periphery of the inner surface of cover 15. In addition to preventing removal of cover 15 from tip 13, ridge 19 seals against the abutment surface 17 to limit air from entering into cavity 21 when a partial vacuum is created in the straw channel 41 and cavity 21 by the sucking action of a person at the end of the straw at hole 23.

In assembly, straw cover 15 must be press-fit over straw tip 13. Abutment surface 17 and ridge 19 are designed as "one-way" tapers to allow for assembly, yet through normal use will not disengage.

Tip 13 also contains holes 29 which communicate into the interior of the container 1 through the closure cap 7, so that when liquid is evacuated through holes 27 and 23 into the mouth of the user, air can enter the container to replace the liquid removed by the user through sucking.

Because there is a seal between abutment surface 17 and ridge 19, air is generally drawn into the container and not into cavity 21 and into the mouth of the user. Additional holes 31 are contained on the straw tip 13 for removal of excess liquid in the cavity 21 after the user has stopped sucking on straw 9. These holes help prevent liquid pressure from building up in cavity 21 when cover 15 is closed, as any excess liquid in cavity 21 will strain into the container through holes 31. As the holes 31 are contained in cavity 21 above the seal created by abutment surface 17 and ridge 19 (when in the open position), air is not easily drawn into the straw through holes 31 when the user sucks at hole 23.

The cover 15 also contains a second ridge 33 which, in the closed position as shown in FIG. 3, abuts the base of the tip along sealing surface 35 so that the cover is sealed to the base below hole 29. An additional ridge may be provided near ridge 33, to touch surface 35 and provide an additional seal at the base of straw 9. In addition, ridge 19 may also touch the base of the tip to provide an additional measure of sealing between the tip 13 and the cover 15.

When in the closed position as shown in FIG. 3, end 25 of tip 13 acts as a stopper completely filling hole 23 to sealingly stop liquid from exiting through hole 23.

Thus, in the closed position cavity 21 is entirely sealed both at the top by end 25 of tip 13 in hole 23 and at the bottom by ridges 19 and 33 abutting sealing surface 35.

As can be seen in FIGS. 3 and 4, the base of the tip 13 is not of uniform diameter. The sealing surface 35 is of a larger diameter than space 37 immediately below abutment ridge 17, so that when the cover is drawn to the open position shown in FIG. 4, neither ridge 33 nor ridge 19 contact the base of tip 13 so as to allow air to enter into hole 29 as previously described.

Tip 13 also contains end 39, the interior of which is adapted so that straw extension 11 (shown in FIG. 1) can be fitted into end 39 to create a continuous internal channel through straw extension 11 and up through channel 41 through holes 27 and 23 so that liquid can exit the container under a vacuum created by a user sucking on straw cover 15.

The tip, cover, container and closure cap are preferably made of plastic or other non-breakable material. The tip and cover are preferably cylindrical in shape but could be made of any matching size and shape.

This description is made with reference to the preferred embodiment of the invention. However, it is possible to make other embodiments that employ the principles of the invention and that fall within its spirit and scope as defined by the following claims.

What is claimed is:

1. A straw for a drinking container comprising:

(i) a tip having an internal channel terminating at a solid closed top and an open bottom and at least one first hole for liquid egress through the side of the tip into the channel and having at least one second hole through the side of the tip into the channel for air intake lower than the first hole;

(ii) an abutment surface of the tip around the outside of the perimeter of the tip between the first hole and the second hole;

(iii) a hollow cover movably retained on the tip and surrounding the tip having a hole at its upper end sized to fit around the solid top of the tip in sealing engagement when in a first closed position and in disengagement when in a second opened position so as to allow liquid to be removed in such second position;

(iv) a first ridge on an inner surface of the cover which is sized to sealingly engage the abutment surface between the first and the second hole when in the second open position; and (v) a second ridge on an inner surface of the cover below the first ridge which is sized to sealingly engage the tip below the second hole when in the first closed position and which disengages from the tip when in the second open position so as to allow air into the second hole in such second position.

2. The straw of claim 1, wherein the straw is part of a closure cap for a drinking container.

3. The straw of claim 2, further including a drinking container to which the closure cap attaches wherein a straw extension is sealingly attached to the open bottom of the tip and extends downwardly to reach a liquid in the container.

4. The straw of claim 1 wherein the tip has a third hole through the side of the tip into the channel located between the first hole and the abutment surface.

5. The straw of claim 4 wherein any of the first, second and third holes are a part of a plurality of holes spaced around the perimeter of the tip.

6. The straw of claim 5 in which the tip and cover are cylindrical.

7. The straw of claim 1 in which the abutment surface extends around the entire outside perimeter of the tip and the first ridge extends around the entire inside perimeter of the cover.

8. The straw of claim 7 in which the second ridges extend around the entire inside perimeter of the cover.

* * * * *